US008444391B2

(12) United States Patent
Jonsson et al.

(10) Patent No.: US 8,444,391 B2
(45) Date of Patent: May 21, 2013

(54) MARINE PROPELLER DRIVE

(75) Inventors: Kare Jonsson, Trollhattan (SE); Benny Hedlund, Hono (SE)

(73) Assignee: AB Volvo Penta, Goteborg (SE)

( * ) Notice: Subject to any disclaimer, the term of this patent is extended or adjusted under 35 U.S.C. 154(b) by 1808 days.

(21) Appl. No.: 11/164,766

(22) Filed: Dec. 5, 2005

(65) Prior Publication Data

US 2006/0198733 A1 Sep. 7, 2006

Related U.S. Application Data

(63) Continuation of application No. PCT/SE2004/000601, filed on Apr. 20, 2004, now abandoned.

(30) Foreign Application Priority Data

Jun. 5, 2003 (SE) ..... 0301644

(51) Int. Cl.
*B63H 20/32* (2006.01)
*B63H 1/20* (2006.01)

(52) U.S. Cl.
USPC ..... 416/244 B; 416/247 A; 440/66; 440/70

(58) Field of Classification Search
USPC ..... 416/93 A, 170 R, 174, 244 B, 245 A, 416/247 A; 440/49, 78, 89 A
See application file for complete search history.

(56) References Cited

U.S. PATENT DOCUMENTS

| | | | | |
|---|---|---|---|---|
| 2,609,783 | A * | 9/1952 | Kiekhaefer | 440/78 |
| 4,295,835 | A | 10/1981 | Mapes et al. | |
| 4,447,214 | A * | 5/1984 | Henrich | 440/66 |
| 4,973,225 | A * | 11/1990 | Kruppa | 416/157 R |
| 5,007,867 | A * | 4/1991 | Kelley | 440/71 |
| 6,123,448 | A * | 9/2000 | Becker et al. | 366/270 |

FOREIGN PATENT DOCUMENTS

WO 0058151 10/2000

OTHER PUBLICATIONS

International Search Report dated May 17, 2004 from International Application PCT/SE2004/000601.

* cited by examiner

*Primary Examiner* — Nathaniel Wiehe
(74) *Attorney, Agent, or Firm* — Martin Farrell; Michael Pruden

(57) ABSTRACT

A propeller drive for boats features a transition cone between the gearbox housing and the propeller hub(s). The propeller hub (that is closest to the gearbox housing) is smaller in cross-sectional dimension than the gearbox housing. The dimension of the front end of the transition cone corresponds to the cross-sectional dimension of the gearbox housing, and the dimension of the rear end of the transition cone corresponds to the cross-section dimension of the (closest) propeller hub. The transition cone has a bulging shoulder between the front and rear ends, the largest peripheral cross-sectional dimension of which is greater than the cross-sectional dimension of the front of the transition cone.

9 Claims, 5 Drawing Sheets

MARINE PROPELLER DRIVE

CROSS-REFERENCE TO RELATED APPLICATIONS

The present application is a continuation patent application of International Application No. PCT/SE2004/000601 filed 20 Apr. 2004 which is published in English pursuant to Article 21(2) of the Patent Cooperation Treaty and which claims priority to Swedish Application No. 0301644-1 filed 5 Jun. 2003. Said applications are expressly incorporated herein by reference in their entireties.

FIELD OF THE INVENTION

The present invention relates to a marine propeller drive for boats. The propeller drive can be mounted on the square stern of a boat or be of the outboard type, and it is provided with a simple impelling propeller or a counter-rotating impelling double propeller.

BACKGROUND OF THE INVENTION

A propeller drive of the above-mentioned type is constructed to meet the demands of the market for much faster boats with much larger and more powerful motors. In order to maintain or increase the operating life of the propeller drive with a much greater effective output, a need arises for a gearbox of correspondingly larger size in relation to a given propeller diameter. In order to avoid cavitation problems at the transition from the gearbox to the propeller hub, it is traditional to strive to dimension the diameter of the propeller hub in such a way that the propeller hub is connected to the gearbox in a "straight" transition, thus without a change in dimension.

An increase in the diameter of the propeller hub can, however, for practical reasons, not always be accompanied by a corresponding increase in the diameter of the propeller since it is known from previous propeller experiments that the degree of efficiency of the propeller drops when the diameter of the propeller hub exceeds about 25% of the propeller diameter. The problem thus arises that the gearbox must be dimensioned so large, for reasons related to power or stability to stress, that the diameter of the propeller hub, in the case of a straight transition between the gearbox and the propeller hub, must exceed the diameter of the propeller by significantly more than 25%.

The problem has therefore been considered to be unsolvable in general, since a conventional straight or slightly curved transition cone has turned out to result in undesirable cavitation around the propeller hub because dissolving takes place already at the first, front end of the transition cone, which is located upstream. The cavitation around the propeller hub also entails a big problem with cavitation erosion of the propeller blades against the root parts adjacent to the hub, loss of efficiency, with the consequence of unfavorable flow behavior in the cavitation zone around the root parts, and pressure impulses at the entrance end of the hub.

As a consequence of the fact that problems are encountered with an enlarged gearbox in comparison with the diameter of the propeller both if a larger hub diameter is selected (leading to a drop in the degree of efficiency of the propeller drops) and if a thin propeller hub is retained in conjunction with a conventional transition cone (leading to cavitation erosion and loss of efficiency), a convention has developed among designers that the gearbox should generally not be dimensioned larger than 25% of the propeller diameter. As mentioned in the introduction, however, in modern high-power motor-drive combinations there is no need to over-dimension the gearbox of the propeller drive in relation to a given propeller diameter in order to maintain or increase the operating life of the propeller drive with this high power output.

SUMMARY OF THE INVENTION

The present invention solves the above problem by implementing a propeller drive that, through its innovative design, gives a series of advantages over known propeller drives with an enlarged gearbox in relation to the propeller diameter, such as a straight transition between gearbox. The design achieves an improved degree of efficiency in comparison to known drives with a propeller hub of the same diameter as the gearbox. Improved flow parameters in front of the propeller are also realized in comparison to known drives with a conventional straight or slightly curved transition cone between gearbox and propeller hub. Also, a more even velocity profile is realized at the transition between gearbox and propeller hub with fewer velocity gradients in front of the propeller hub in comparison to known drives with a conventional straight or slightly curved transition cone between gearbox and propeller hub. Further, higher absolute pressure at the propeller hub in comparison to known drives is also achieved with a conventional straight or slightly curved transition cone between gearbox and propeller hub, which minimizes the risks of cavitation. Finally, reduced turbulence intensity is also achieved around the propeller hub and the root parts of the propeller blades in comparison to known drives with a conventional straight or slightly rounded transition cone between gearbox and propeller hub which eliminates cavitation erosion in said root parts.

The invention provides a marine propeller drive for boats that comprises (includes, but is not necessarily limited to) a gearbox for a motor transmission and an attached impelling propeller. The propeller is provided with a propeller hub, the main peripheral cross-section dimension of which is less than the main peripheral cross-section dimension of the gearbox. A transition cone is located between the gearbox and the propeller hub. The transition cone includes a front-end located in connection with the gearbox, where said front end has an initial peripheral cross-section dimension essentially corresponding to the main peripheral cross-section dimension of the gearbox. The rear end located in connection with the propeller hub, where said rear end has a final peripheral cross-section dimension essentially corresponding to the main peripheral cross-section dimension of the propeller hub. The invention is distinguished in particular by the fact that the transition cone includes a bulb-shaped shoulder part inserted between said front end and rear end, the largest peripheral cross-section diameter of which exceeds the initial peripheral cross-section dimension of the transition cone.

In a preferred embodiment, the largest peripheral cross-section dimension of the shoulder part is located axially closer to the front end of the transition cone than to its rear end.

In a preferred embodiment of the invention, the largest peripheral cross-section dimension of the shoulder part is located at an axial distance from the front end of the transition cone corresponding to 10-40% of the length of the transition cone and advantageously to 10-30% of the length of the transition cone.

Further, in a suitable embodiment, the largest peripheral cross-section dimension of the shoulder part exceeds the initial peripheral cross-section dimension of the transition cone by 3-10%, preferably 5-7%.

The largest peripheral cross-section dimension of the shoulder part expediently exceeds the rear peripheral cross-section dimension of the transition cone by 10-30%, preferably 15-20%.

The shoulder part is further defined by a continuously arched curve extending from the front end of the transition cone to its rear end.

The above advantages and characteristics of the propeller drive according to this invention will be evident from the detailed description of the embodiments which follows.

BRIEF DESCRIPTION OF THE DRAWINGS

Embodiments of the invention will be described below in more detail with reference to the accompanying drawings, in which.

DETAILED DESCRIPTION

Figure 1:
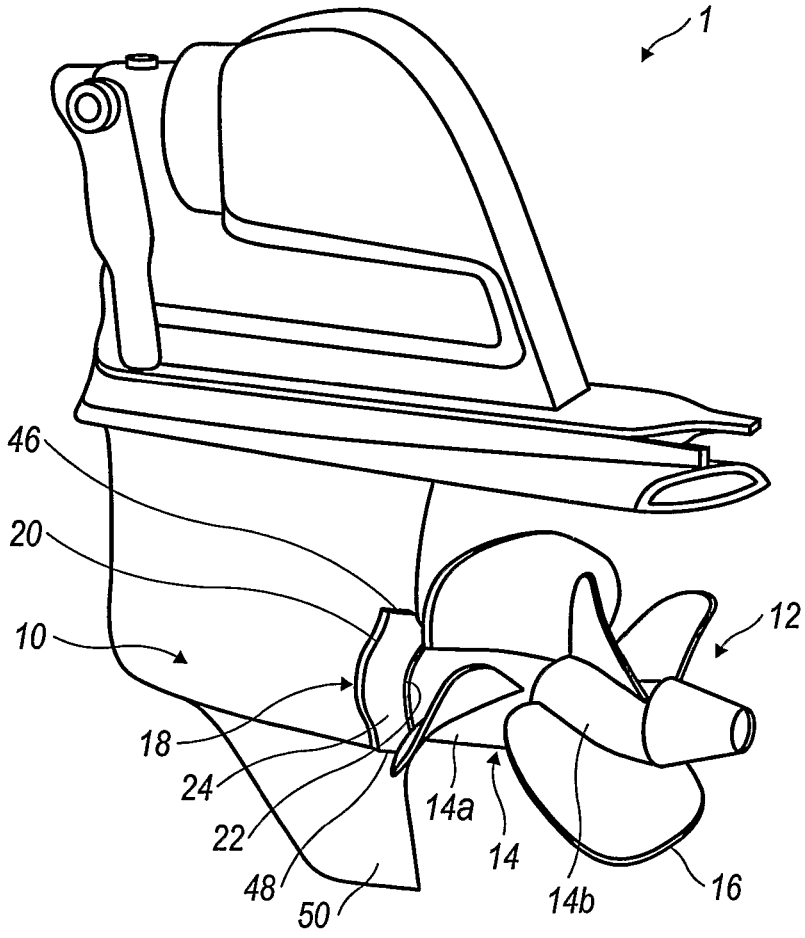
FIG. 1 shows a perspective view of a marine propeller drive according to an embodiment of the invention.

A marine propeller drive 1 for boats is shown in FIG. 1 that is configured according to the present invention. The propeller drive 1 in the embodiment shown is mounted on the square stern of the boat, but it can alternatively also be of the outboard type (not shown). The propeller drive is envisioned primarily for fast boats, i.e. boats with a top speed exceeding about 20 knots, but it can also be used with slower boats.

The propeller drive 1 includes a lower gearbox 10, which contains part of a motor transmission (not shown). The motor transmission is connected in a known manner to a motor in a boat. Neither the motor nor the boat is shown in the figures since these components are well known to those persons skilled in these arts. In the embodiment shown, the gearbox 10 has a shape similar to that of a wing profile. The propeller drive 1 also includes a counter-rotating impelling double propeller 12, but in an alternative embodiment (not shown), it can also be provided with a single impelling propeller. The propeller (12) has, in a known manner, a propeller hub 14 consisting of two counter-rotating hub parts 14*a*, 14*b* in the case of a double propeller, and a number of propeller blades 16 inserted therein.

Figure 2:
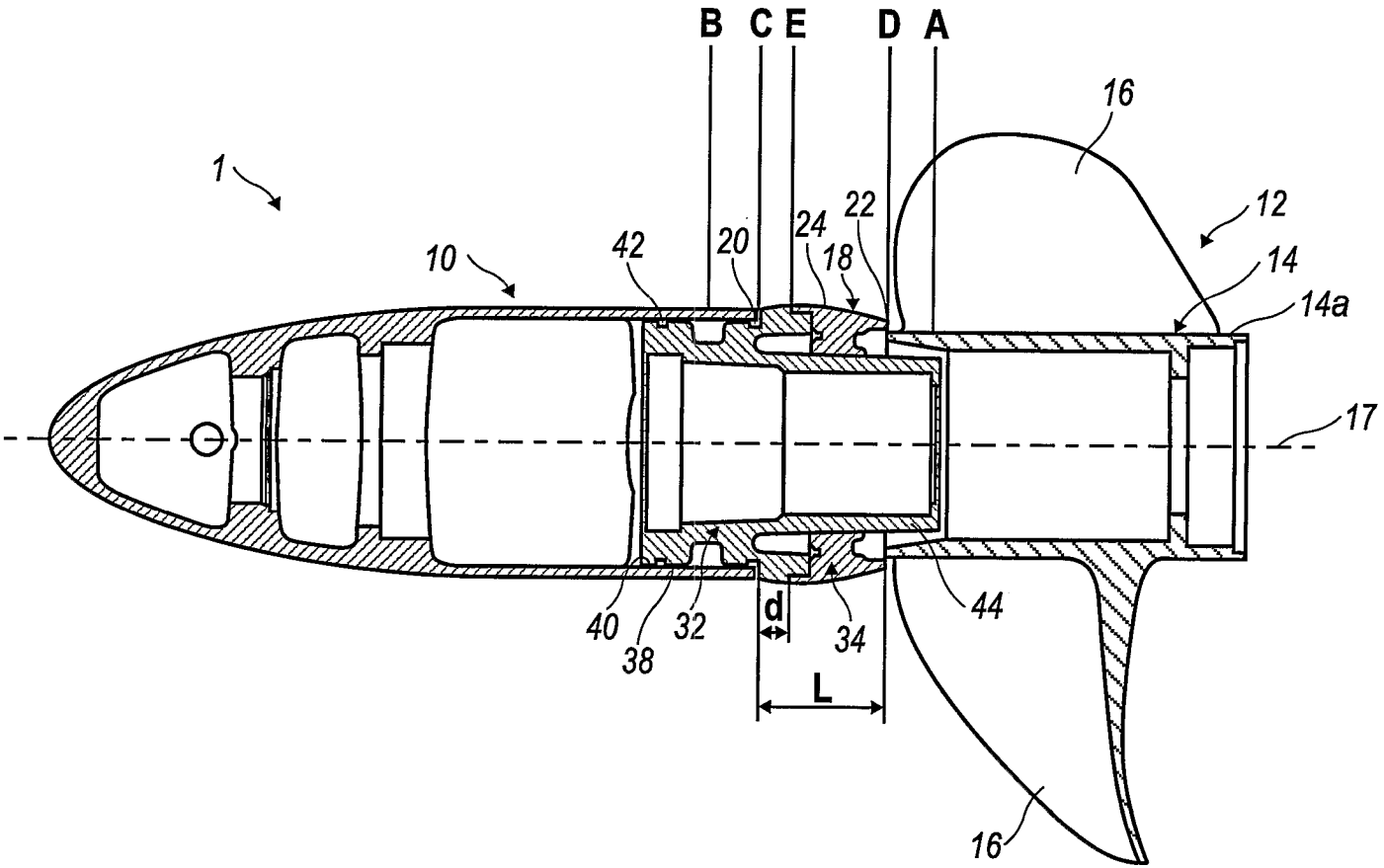
FIG. 2 shows a simplified longitudinal partial cross-section view of the propeller drive in FIG. 1.

The invention will now be described in more detail with reference to FIG. 2, which shows a simplified longitudinal partial cross-section of the propeller drive in FIG. 1. In FIG. 2, the inner contents of the gearbox 10 are not shown, for reasons of clarity. Also, of the two counter-rotating hub parts 14*a*, 14*b*, which constitute parts of the counter-rotating double propeller in a known manner, only the front one is shown. The propeller 12 is connected to the gearbox 10 in a known manner through a propeller axle, not shown. In FIG. 2, a number of other peripheral cross-section dimensions that are relevant for the invention have been indicated with capital letters A-E via vertical reference lines to the axial positions where the respective cross-section dimensions are located.

In FIG. 2, it can also be seen that the main peripheral cross-section dimension A of the propeller hub 14 is less than the main peripheral cross-section B of the gearbox. In the embodiment shown, for example, the ratio of cross-section dimensions A to B is approximately A=0.75(B), which thus corresponds to a propeller hub 12 that is about 25% thinner than the gearbox 10.

According to the invention, a bulb-shaped transition cone 18 is inserted between the gearbox 10, which has relatively large dimensions, and the propeller hub 14, which is relatively thin.

Again with reference to FIG. 2, the transition cone 18 has a front end 20 located in connection with the gearbox 10 and a rear end 22 located in connection with the propeller hub 14.

In this case the front end 20 of the transition cone 18 has an initial peripheral cross-section dimension C, essentially corresponding to the main peripheral cross-section dimension B of the gearbox 10. By "essentially" it is meant here that the initial cross-section dimension C of the front end 20 can be dimensioned intentionally in practice to be marginally less than the cross-section dimension B of the gearbox 10, as is the case in FIG. 2, for the purpose of ensuring that a "step" which is unfavorable in terms of flow and projects abruptly, radially outward as a consequence of tolerance imprecisions in production is avoided during the transition from the gearbox 10 to the transition cone 18.

The rear end 22 of the transition cone 18 has a final peripheral cross-section dimension D that corresponds essentially to the main peripheral cross-section dimension A of the propeller hub 14. For a similar reason, but reversed here, as with the transition from the gearbox 10 to the transition cone 18, the term "essentially" implies that the cross-section dimension D of the final rear end 22 can be dimensioned intentionally in practice to exceed the cross-section dimension B of the propeller hub to some extent (which is the case in FIG. 2) for the purpose of ensuring that a "step" which is unfavorable in terms of flow and projects abruptly radially outward as a consequence of tolerance imprecisions in production is avoided during the transition from the transition cone 18 to the propeller hub 14.

The basic principle of the invention is that the transition cone 18 includes a bulb-shaped shoulder part 24 located between said front end 20 and rear end 22, the largest peripheral cross-section dimension E of which exceeds the initial peripheral cross-section dimension C of the transition cone 18. As clearly shown in FIG. 2, the bulb-shaped shoulder part 24 consists of a continually arched curve extending from the front end 20 of the transition cone 18 to its rear end 22. In this connection, moreover, the largest peripheral cross-section dimension E of the shoulder part 24 is located axially closer to the front end 20 of the transition cone 18 than to its rear end 22.

In FIG. 2, it is shown that the largest peripheral cross-section dimension E of the bulb-shaped shoulder part 24 is located at an axial distance d from the front end 20 of the transition cone 18. The distance d corresponds appropriately, according to the invention, to 10-40% of the length L of the transition cone 18, preferably 20-30%. In the embodiment shown, the distance d corresponds to about 25% of the length L of the transition cone 18.

The largest peripheral cross-section dimension E of the shoulder part 24 appropriately exceeds the initial peripheral cross-section dimension C of the transition cone 18 by 3-10%, preferably 5-7%.

Further, the largest peripheral cross-section dimension E of the shoulder part 24 appropriately exceeds the rear peripheral cross-section dimension D of the transition cone 18 by 10-30%, preferably 15-20%.

The function and advantages behind the bulb-shaped shoulder part 24 will now be discussed with reference to FIG.

3, which shows an enlarged cross-section view of part of the propeller drive 1 according to the invention. In the diagram, a continuous-flow arrow 26 is shown, which describes the movement of a liquid particle along the propeller drive 1. Starting from the left in the diagram, the liquid particle moves along the flow arrow 26 in a laminar flow zone Z1, which extends from the nose of the gearbox 10 (not shown in the figure).

At a transition point, the liquid particle enters a transition zone Z2, where a transition from laminar flow to turbulent flow occurs. Within the transition zone Z2, the liquid particle is subjected at an early stage to a locally increased pressure in front of it in a region designated as pressure zone 1, which is indicated in FIG. 2 with dotted lines and which is located essentially in front of the bulb-shaped shoulder part 24 of the transition cone 18. The liquid particle is consequently forced here by the higher pressure in front to change its flow path out from the gearbox 10, as can be seen in FIG. 2. The liquid particle then passes into a turbulent flow zone Z3, within which the bulb-shaped shoulder part 24 is located. The flow velocity increases around the bulb-shaped shoulder part 24, which causes an increase in the kinetic energy of the liquid and a locally reduced pressure in comparison to the surrounding pressure. Through the increased velocity around the shoulder part 24, the risk of the particle detaching is reduced and the liquid particle is again forced to change its flow path inward so that it progresses in toward the rear end 22 of the shoulder part 24 without detaching. Further, in a pressure zone III, a stagnation pressure prevails that exceeds the surrounding pressure in connection with the rear end 22 of the shoulder part and onward over the propeller hub 14. A significant increase in the absolute pressure within pressure zone III leads the liquid particle to contact the propeller hub 14 and the turbulence intensity around the propeller hub 14 and the root parts 30 of the propeller blade 16 is reduced significantly in comparison to a propeller drive (not shown) with a conventional straight or slightly curved transition cone between gearbox 10 and propeller hub 14. In this way, cavitation erosion in said root parts 30 is eliminated.

The presence of the bulb-shaped shoulder part 24 on the transition cone leads to a certain increase in the total flow-resistance of the propeller drive 1, but this is compensated perfectly well by the marked increase in the degree of propeller power. As mentioned previously, the relatively wide gearbox 10 in comparison to conventional drives makes it possible for the transmission parts (not shown) of the propeller drive 1 to be dimensioned significantly larger. In this way, a propeller drive is obtained with a significantly longer operating life than with conventional drives.

Figure 3:
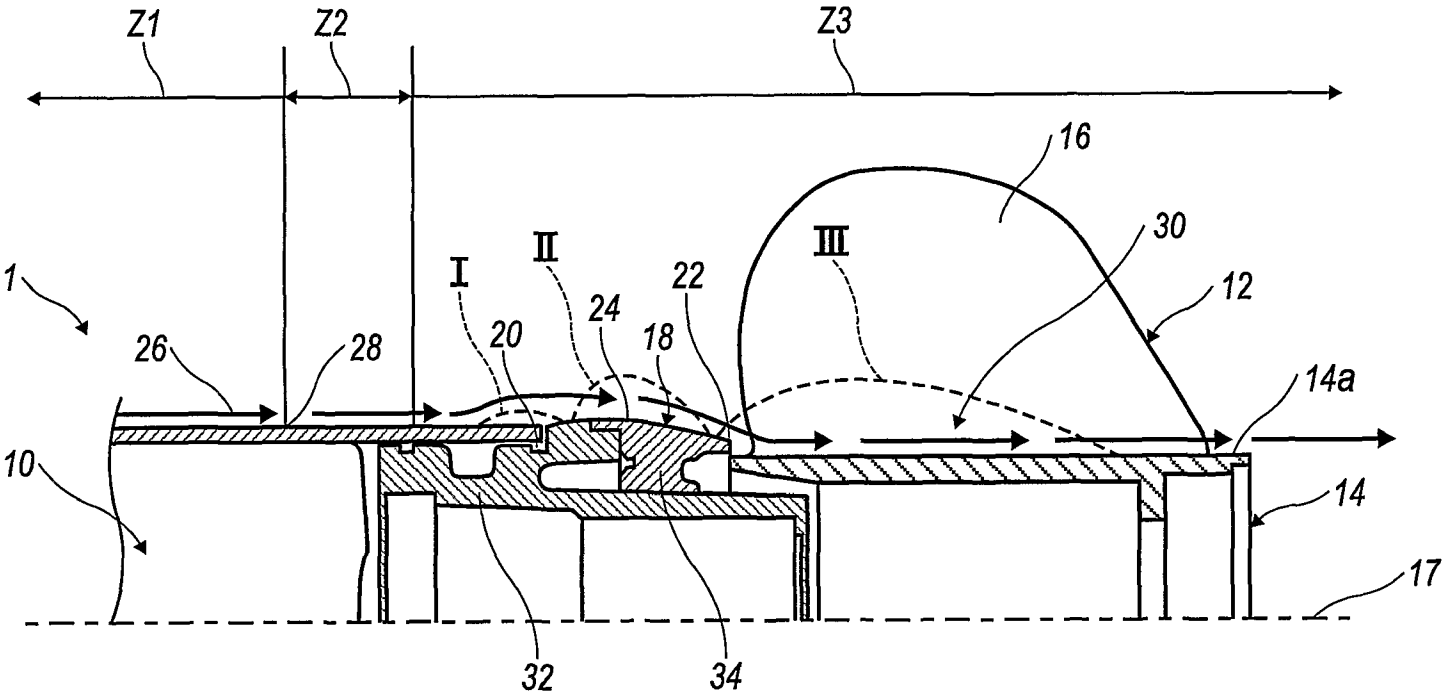
FIG. 3 shows an enlarged overall cross-section view of the propeller drive according to the invention, where flow line and pressure zones are indicated schematically.
Figure 4:
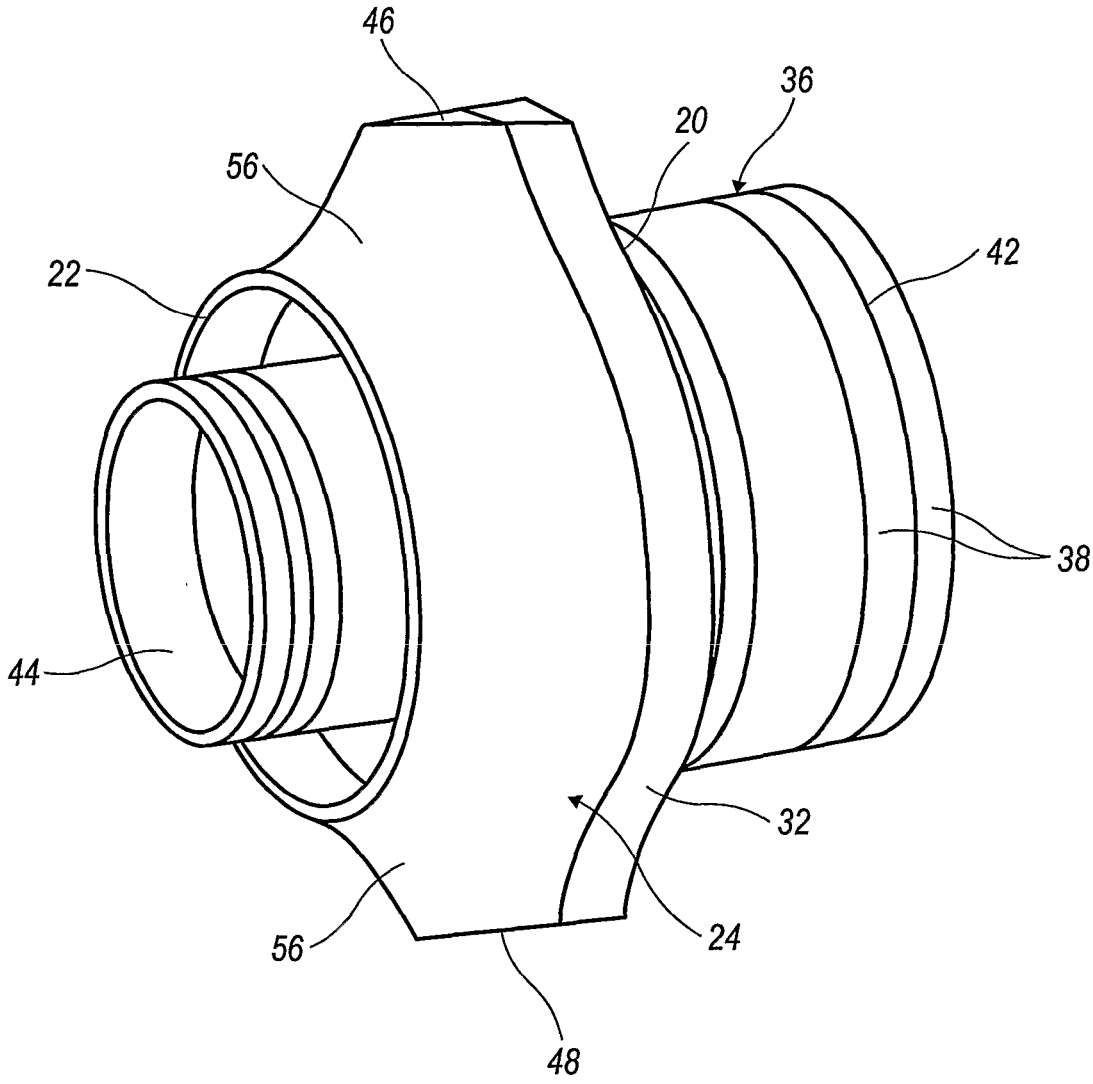
FIG. 4 shows a perspective view of the bulb-shaped transition cone according to the invention.

In FIG. 4, a separate perspective view is shown of the transition cone 18 according to the invention, where the bulb-shaped shoulder part 24 can be seen clearly. In the exemplary embodiment shown, the transition cone 18 is, as can also be seen in FIG. 2 and FIG. 3, constructed from a front half 32 and a rear half 34. The front half 32 here has a cylindrical connection part 36 which projects forward into the gearbox 10 and has contact surfaces 38 facing radially outward toward corresponding contact surfaces 40 facing radially inward and made in the gearbox 10. The cylindrical connection part has a surrounding sealing groove 42 for a sealing ring (not shown). The front half also has an inner sleeve part 44 facing backward, around which the rear half 34 is attached and which extends toward the propeller 14. The sleeve part 44 also surrounds the propeller axle, not shown in the figures.

As can be seen in FIG. 4, the transition cone 18 is provided with an upward-pointing upper collar neck 46 for form-fitting connection to the upper propeller drive 1 and a downward-pointing lower collar neck 48 for form-fitting connection to a fixed lower stabilization wing, a so-called "skeg" 50, which is shown only in the overall view in FIG. 1.

Figure 5:
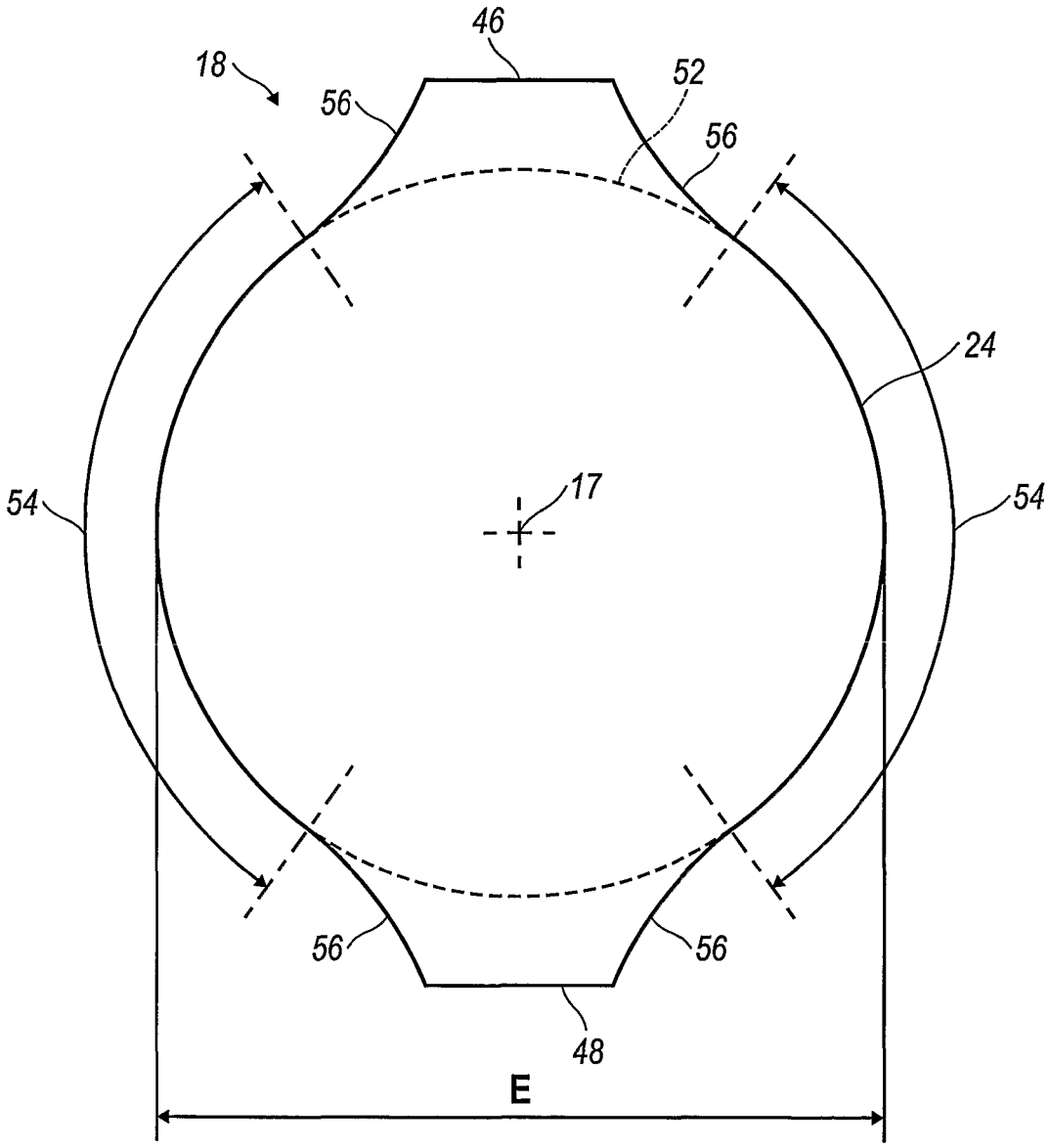
FIG. 5 shows a schematic cross-section through the transition cone at its largest cross-section dimension.

Finally, in FIG. 5, a schematic cross-section through the transition cone 18 is shown at its largest cross-section dimension (E). As can be seen from the figure, the shape of the cross-section of the transition cone 18 deviates from a body with rotation symmetry at both collar necks 46,48. The body with rotation symmetry is illustrated schematically in the figure by means of a circle 52 completed with dotted lines. As already mentioned briefly in the introduction, the peripheral cross-section dimensions A, B, C, D, and E given in the description refer to the general average outside cross-section dimensions, thus diameters of the portions of the given parts having rotation symmetry (in FIG. 5: the transition cone). In FIG. 5, these portions having rotation symmetry are indicated with the common reference designation 54. The two collar necks 46, 48, however, appear on suitably bent side surfaces 56, which are connected to the portions 54 having rotation symmetry of the rotation body 52. In the perspective view in FIG. 4, it is shown that the side surfaces 56 are partly bent doubly, in order to follow the three-dimensional flow-line form of the propeller drive 1.

The invention is not limited to the embodiment examples described above and in the diagrams, but can be varied freely within the framework of the following patent claims. For example, the transition cone can alternatively be formed in one piece or with another subdivision than that shown in the embodiment examples. Although the transition cone 18 is described above as a separate unit between the gearbox 10 and the propeller 12, it can be formed as an integrated part of the gearbox 10.

To aid in correlation with the drawings, the following reference listing is provided: Propeller drive (1), Gearbox (10), Propeller (12), Propeller hub (14), Front hub part (14*a*), Rear hub part (14*b*), Propeller blade (16), Center line of the propeller (17), Transition cone (18), Front end of the transition cone (20), Rear end of the transition cone (22), Bulb-shaped shoulder part (24), Flow tube (26), Transition point (28), Root parts of the propeller blade (30), Front half of the transition cone (32), Rear half of the transition cone (34), Cylindrical connection part (36), Contact surfaces facing outward (38), Contact surfaces facing inward (40), Sealing groove (42), Inner sleeve part (44), Upper collar neck (46), Lower collar neck (48), Skeg (50), Circle illustrating a body with rotation symmetry (52), Parts with rotation symmetry (55), and Bent side surfaces (56); A: Main peripheral cross-section dimension of the propeller hub of the transition cone and at the front end of the transition cone; B: Main peripheral cross-section dimension of the gearbox; C: Initial peripheral cross-section dimension of the transition cone; D: Final peripheral cross-section dimension of the transition cone; E: Largest peripheral cross-section dimension of the shoulder part; L: Length of the transition cone; d: Axial distance from the front end of the transition cone to the largest cross-section dimension of the shoulder part; Z1: Laminar-flow zone; Z2: Transition zone; Z3: Turbulent zone; I: Pressure zone with locally higher pressure around the gearbox in front of the transition cone and at the front end of the transition cone; II: Pressure zone with locally lower pressure around the front end of the transition cone; and III: Pressure zone with locally higher pressure around the rear end of the transition cone and in the upper propeller hub.

What is claimed is:

1. A marine propeller drive (1) for boats comprising:

a gearbox (10) for a motor transmission and an associated impelling propeller (12), said propeller (12) being provided with a propeller hub 14 the main peripheral cross-section dimension (A) of which is less than the main peripheral cross-section dimension (B) of the gearbox (10) and in which a transition cone (18) is located between the gearbox (10) and the propeller hub (14);

said transition cone (18) having a front end (20) located in connection with the gearbox (10), where said front end (2) has an initial peripheral cross-section dimension (C) essentially corresponding to the main peripheral cross-section dimension (B) of the gearbox (10) and a rear end (22) located in connection with the propeller hub (14), where said rear end (22) has a final peripheral cross-section dimension (D) essentially corresponding to the main peripheral cross-section dimension (A) of the propeller hub (14);

said transition cone (18) further comprising a bulb-shaped shoulder part (24) located between said front end (20) and rear end (22), the largest peripheral cross-section dimension (E) of which exceeds the initial peripheral cross-section dimension (C) of the transition cone (18), wherein the largest peripheral cross-section dimension of the shoulder part (24) is located axially closer to the front end (20) of the transition cone (18) than to the rear end (22) thereof.

2. A marine propeller drive (1) as recited in claim 1, wherein the largest peripheral cross-section dimension (E) of the shoulder part (24) is located at an axial distance (d) from the front end (20) of the transition cone (18), corresponding to 10-40% of the length (L) of the transition cone (18).

3. A marine propeller drive (1) as recited in claim 1, wherein the largest peripheral cross-section dimension (E) of the shoulder part (24) is located at an axial distance from the initial end (20) of the transition cone (18), corresponding to 20-30% of the length (L) of the transition cone (18).

4. A marine propeller drive (1) as recited in claim 3, wherein the largest peripheral cross-section dimension (E) of the shoulder part (24) is located at an axial distance (d) from the front end (20) of the transition cone (18), corresponding to 25% of the length (L) of the transition cone (18).

5. A marine propeller drive (1) as recited in claim 1, wherein the largest peripheral cross-section dimension (E) of the shoulder part (24) exceeds the initial peripheral cross-section dimension (C) of the transition cone (18) by 3-10%.

6. A marine propeller drive (1) as recited in claim 5, wherein largest peripheral cross-section dimension (E) of the shoulder part (24) exceeds the initial peripheral cross-section dimension (C) of the transition cone (18) by 5-7%.

7. A marine propeller drive (1) as recited in claim 1, wherein the largest peripheral cross-section dimension (E) of the shoulder part (24) exceeds the rear peripheral cross-section dimension (D) of the transition cone (18) by 10-30%.

8. A marine propeller drive (1) as recited in claim 7, wherein the largest peripheral cross-section dimension (E) of the shoulder part exceeds the rear peripheral cross-section dimension (D) of the transition cone (18) by 15-20%.

9. A marine propeller drive (1) as recited in claim 1, wherein the shoulder part (24) is defined by a continuously arched curve extending from the front end (20) of the transition cone (18) to the rear end (22) thereof.

* * * * *